US005601121A

United States Patent [19]

Bonacina

[11] Patent Number: 5,601,121

[45] Date of Patent: Feb. 11, 1997

[54] DEVICE FOR CONTROLLING THE GRIPPER STRAPS ON LOOMS

[75] Inventor: Carlo Bonacina, Nibionno, Italy

[73] Assignee: Intrapatent Limited, Dublin, Ireland

[21] Appl. No.: 424,287

[22] PCT Filed: Oct. 25, 1993

[86] PCT No.: PCT/EP93/02955

§ 371 Date: Jun. 20, 1995

§ 102(e) Date: Jun. 20, 1995

[87] PCT Pub. No.: WO94/10363

PCT Pub. Date: May 11, 1994

[30] Foreign Application Priority Data

Oct. 23, 1992 [IT] Italy ..... CO92A0014

[51] Int. Cl.[6] ..... D03D 47/12

[52] U.S. Cl. ..... 139/449; 74/89.15

[58] Field of Search ..... 139/449; 74/89.15, 74/59, 58, 23

[56] References Cited

U.S. PATENT DOCUMENTS 4,052,906 10/1977 Genini ..... 139/449

4,624,288 11/1986 Pezzoli ..... 139/449

5,320,143 6/1994 Hwang et al. ..... 139/449

FOREIGN PATENT DOCUMENTS 0164627 12/1985 European Pat. Off. .

2303876 10/1976 France .

560882 2/1946 United Kingdom .

2228748 9/1990 United Kingdom .

*Primary Examiner*—Andy Falik

*Attorney, Agent, or Firm*—Ladas & Parry

[57] ABSTRACT

A device for controlling weft carrying grippers on a continuous weft feed loom has a connecting rod-crank mechanism that controls rectilinear translation of a slide along a fixed guide. The slide has an internal nut screw that engages a worm that is mounted in idleable manner on a fixed support that is integral with the guide and fitted with a pinion for controlling the gripper strap. The nut screw is made up of at least two elements having respective worm followers. The elements are movable relative to each other along the worm axis by a cam but angularly fixed relative to the slide or to another element mounted on the slide so that the angular position of the elements is controlled by a cam as a function of the axial position of the slide.

8 Claims, 3 Drawing Sheets

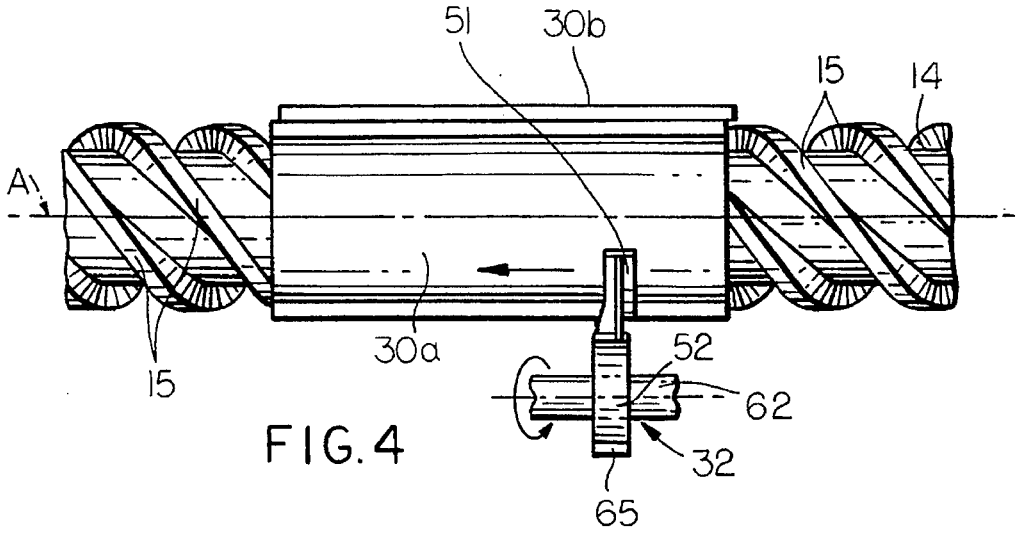
FIG. 4
FIG. 5
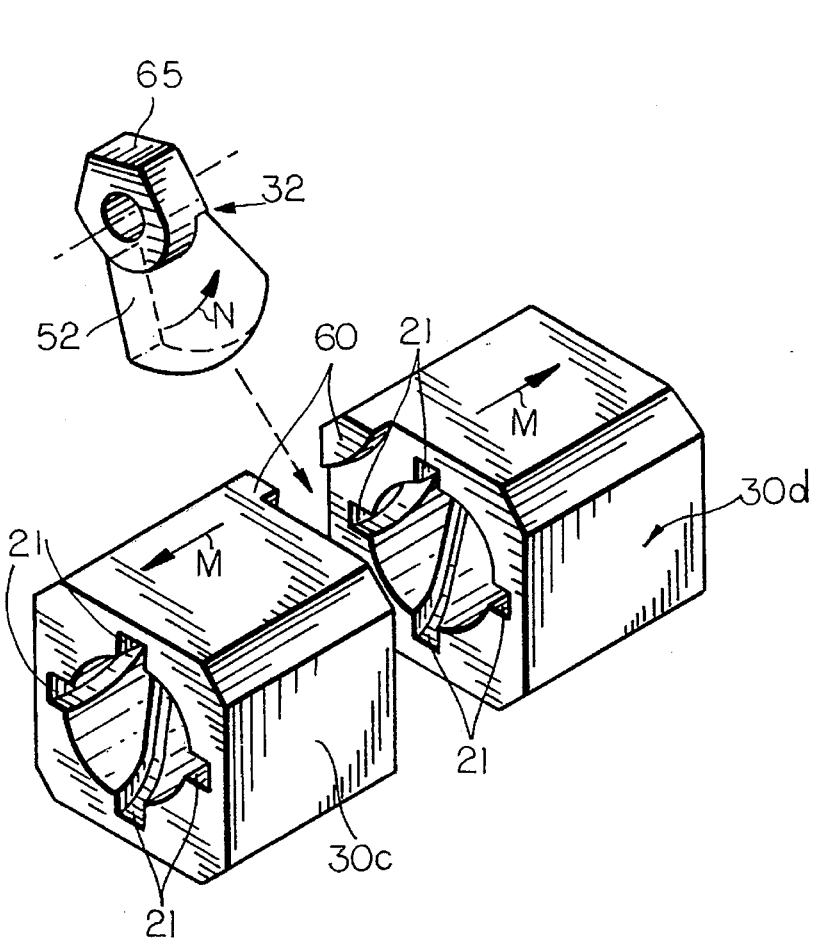

DEVICE FOR CONTROLLING THE GRIPPER STRAPS ON LOOMS

TECHNICAL FIELD

The present invention relates to a device for controlling the gripper straps on looms, and in particular for controlling, according to a desired law of motion, both a positive and negative weft carrying gripper on a continuous weft feed loom.

BACKGROUND ART

Known devices for controlling the gripper straps on continuous weft feed looms consist, as e.g. shown by FR-A-2303876, of a connecting rod-crank drive mechanism for translating along a straight guide a slide fitted with means for engaging a variable-pitch worm screw mounted in idle manner parallel to, and on a support integral with, the guide. The screw is thus rotated, by the reciprocating translatory movement of the slide, so as to transmit a reciprocating rotatory movement, to a toothed pinion fitted angularly integral with the screw, and which in turn, and in known manner, controls translation of a flexible gripper strap wound partially about the pinion.

Known devices of the aforementioned type, though they do provide for varying the law of motion of the gripper strap by means of a relatively straightforward mechanical operation on the device itself, and for gradually taking up any slack between the screw profiles (or threads) and means for reading/engaging the same, are nevertheless mechanically complex, expensive to produce, and unreliable, particularly as regards the reading/engaging means which normally consist of idle rollers with an oblique axis in relation to the screw.

DISCLOSURE OF INVENTION

It is an object of the present invention to provide a straightforward, reliable, relatively inexpensive device for controlling the gripper straps on continuous weft feed looms, and which provides for taking up any slack in the straps. It is a further object of the present invention that the above device should be easily adaptable for enabling variations in the law of motion of the gripper strap and so converting the negative gripper control device into a positive gripper control device and vice versa, with no need for specialized (only trained) personnel, and in a relatively short space of time (2–3 hours).

According to the present invention, there is provided a device for controlling the gripper straps on continuous weft feed looms, and of the type comprising a connecting rod-crank drive mechanism for controlling translation of a slide along a straight path defined by fixed guide means; a worm screw parallel to said path and mounted in idle manner on a fixed support integral with said guide means, the worm screw being fitted to a pinion controlling the gripper strap; and a nut screw carried by the slide and having worm screw reading means by which it engages the worm screw for rotating it as a consequence of translation of the slide along said path; the nut screw comprising at least two half elements each having said worm screw reading means, these means being adjustable relative to the worm screw in order to maintain a desired level of slack; characterized in that:

(i)—said at least two half elements are carried by the slide so as to be movable relatively in relation to each other along the worm screw axis;

(ii)—the device further comprising first cam means carried either by the slide and by a nut screw body for relatively displacing in opposite directions said half elements of the nut screw, such that any slack between respective worm screw threads and said reading means can be taken up.

According to a first embodiment of the present invention, the half elements consist of two half shells formed by longitudinally sectioning the nut screw along a diametrical plane of the worm screw. A first half shell is mounted in axially fixed manner, while the other is mounted in axially movable manner, and presents an opening in which is inserted in axially slack manner a spherical-wedge-shaped cam varying angularly in axial thickness.

According to a second embodiment of the present invention, the half elements of the nut screw consist of two rings formed by transversely sectioning the nut screw perpendicular to the worm screw axis, and the two rings are both mounted in axially movable manner, with the spherical-wedge-shaped cam inserted between the adjacent ends of the same and cooperating with both.

The spherical-wedge-shaped cam is mounted for rotation, parallel to the worm screw axis, inside a radial seat in which it is lockable angularly via axial pressure means; and the half elements are fitted in angularly fixed manner inside a nut screw body mounted in axially fixed but angularly idle manner on the slide about the worm screw axis. The angular position of the nut screw body may be fixed by means of a lock member, or controlled as a function of the axial position of the slide by second cam means mounted-integral with said fixed support.

This therefore provides for an intrinsically straightforward, reliable, inexpensive device, capable, nonetheless, of taking up any working slack between the worm and nut screw. Moreover, the same device may be produced in a simplified "basic" version permitting no adjustment (unless by operating in conventional manner on the linkages) to the law of motion imparted to the gripper strap, by virtue of the nut screw body in which the two (or more) half elements are housed being formed in one piece with (or fitted to) the slide; or in a "perfected" version featuring a worm rotation "correcting" mechanism coaxial with the worm, and which provides for adjusting speed in a truly straightforward, reliable and flexible manner. The latter version, which is destined to operate predominantly with positive gripper controls operating at slower speeds but requiring greater characterization of the law of motion for meeting various weaving requirements, is nevertheless convertible into the "basic" version by simply removing the second cam means and fitting the nut screw body to the slide, thus enabling operation with less characteristic laws of motion but at higher speeds typical, for example, of negative gripper control requirements.

BRIEF DESCRIPTION OF DRAWINGS

Further objects and advantages will be revealed in the following description of a preferred non-limiting embodiment of the present invention, and with reference to the accompanying drawings, in which:

FIG. 4 shows a larger-scale top plan view of a detail on the FIG. 1 device;

FIG. 5 shows a possible variation of a second detail on the FIG. 1 device;

BEST MODE FOR CARRYING OUT THE INVENTION

Figure 1:
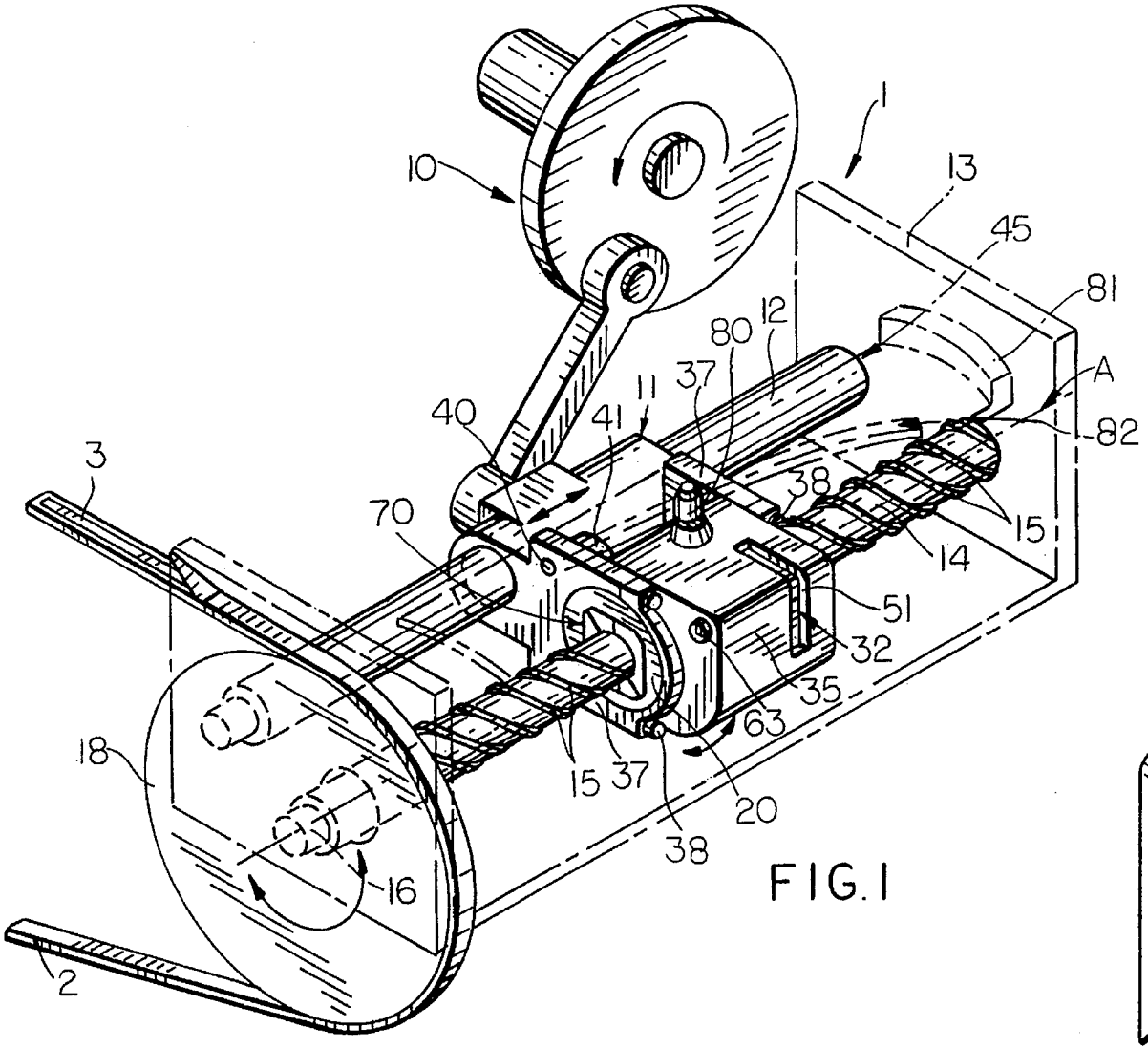
FIG. 1 shows a schematic view of the main components of a device in accordance with the present invention.

Number 1 in FIG. 1 indicates a device for controlling the control strap 2 of a known weft carrying gripper 3 (shown only schematically for the sake of simplicity) on a known continuous weft feed loom (not shown). Device 1 comprises a known connecting rod-crank drive mechanism 10 for controlling translation of a slide 11 along a straight path defined by fixed guide means consisting, in the example shown, of a straight cylindrical bar 12 mounted on a fixed support or frame 13 on which mechanism 10 is also mounted together with a known motor (not shown). A fixed-pitch worm screw 14 with a number of threads 15 (four in the example shown) is provided parallel to the path of slide 11 and mounted in idle manner on support 13.

Worm 14 rotates about its own axis A parallel to bar 12, and is fitted, on end 16 projecting from support 13, with a known pinion 18 controlling gripper strap 2, which, being flexible, winds partially about pinion 18 and meshes with it like a rack by means of holes (not shown) engaged successively by the teeth on pinion 18. Device 1 is functionally completed by a nut screw 20 carried on slide 11 and having means for reading (or engaging) worm 14 and defined, in the example shown, by straightforward helical grooves 21, each engaged by a respective thread 15.

By means of grooves 21, nut screw 20 meshes with worm 14 for rotating it as a consequence of translation of slide 11 along bar 12. Consequently, the reciprocating motion produced by mechanism 10 is converted into reciprocating translatory movement of slide 11; which results in reciprocating rotation of worm 14 depending on the geometric characteristics of threads 15; which is converted into reciprocating rotation of pinion 18 in the direction of the arrows (FIG. 1), and into reciprocating translation, of strap 2 meshing with pinion 18, and therefore also of gripper 3.

According to the present invention, nut screw 20 comprises two (in the example shown) or more (according to a variation not shown) half elements 30*a*, 30*b* (FIGS. 2 and 3) having respective worm reading means 21, and mounted on slide 11 so as to move relatively in relation to each other along axis A of worm 14. Slide 11 also presents cam means 32 for relatively displacing half elements 30*a*, 30*b* (cf. 30*c*, 30*d*, of FIG. 5) in opposite directions (e.g. as shown more clearly by the straight arrows on half elements 30*c*, 30*d* in FIG. 5 for movement of cam 32 as shown by the curved arrow in FIG. 5) to take up any wear-induced or post-assembly slack between threads 15 (e.g. FIG. 1) and grooves 21 of nut screw 20 (e.g. FIG. 3).

Figure 2:
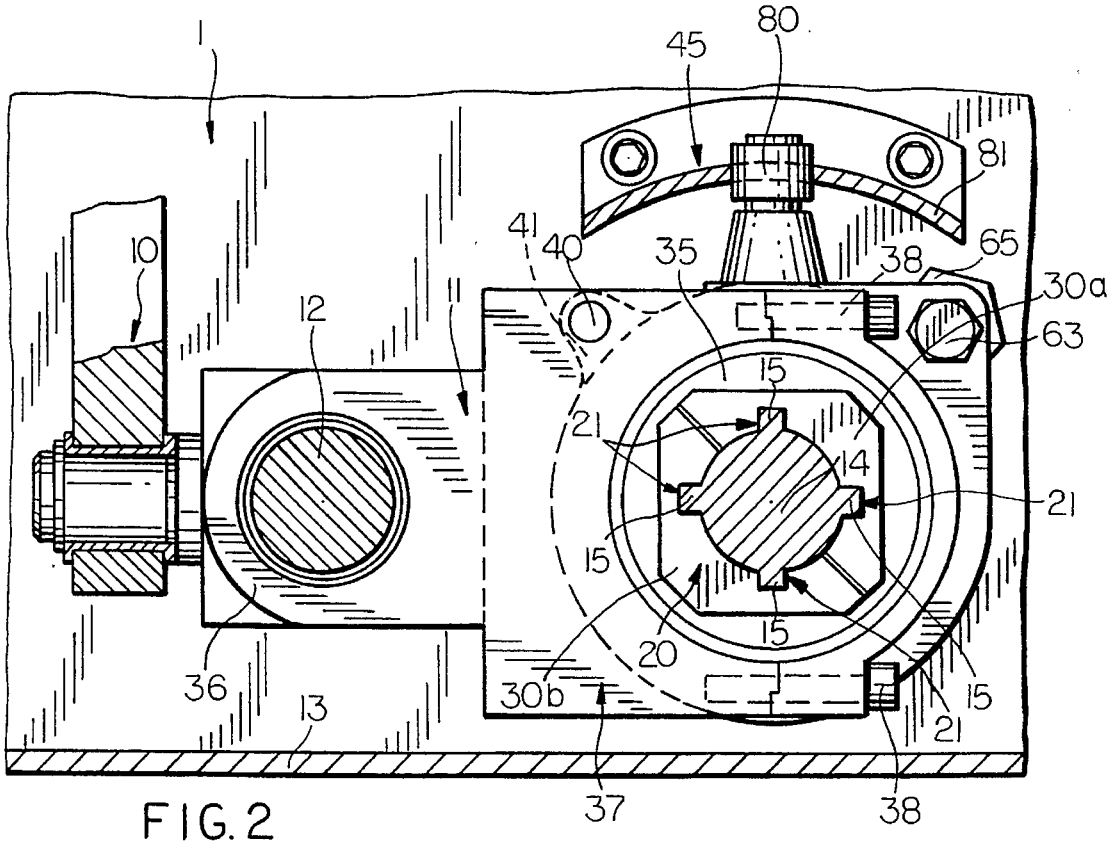
FIGS. 2 and 3 show respective larger-scale cross sections of different axial portions of the FIG. 1 device.
Figure 3:
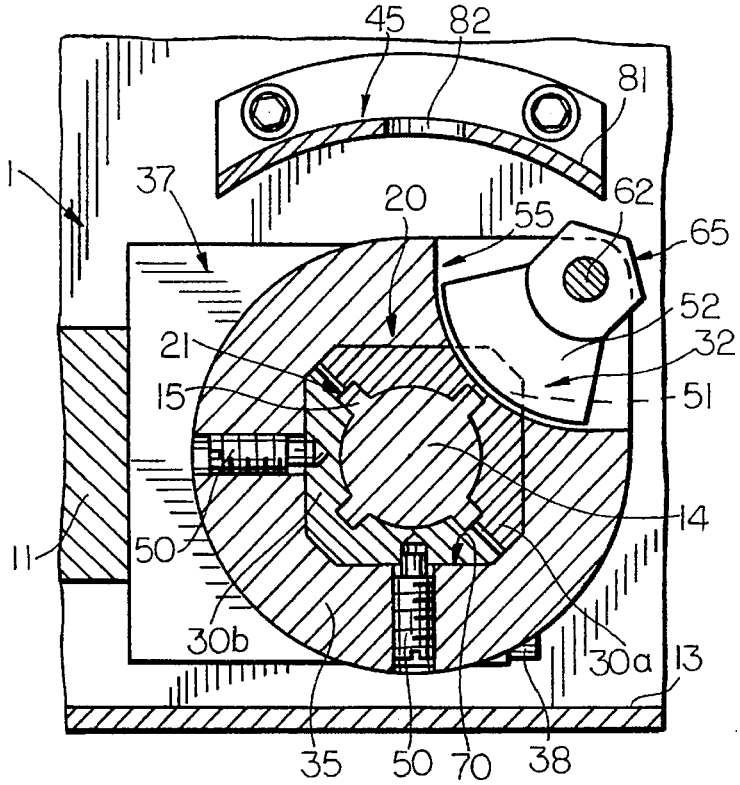

With special reference to FIGS. 2, 3 and 4, half elements 30*a* & *b* are fitted in angularly fixed manner inside a substantially cylindrical nut screw body 35 axially integral with slide 11. Body 35 may be mounted integral in one body with slide 11, e.g. formed in one piece with the same, or, as in the example shown and for the reasons explained later on, be mounted in axially fixed but angularly idle manner on slide 11, about axis A of worm 14. For example, slide 11 presents an eye, or rather slider, 36 engaging bar 12 in sliding manner; and a pair of supporting tabs 37, each shaped like a main bearing with two half rings secured by studs 38 (or other means), which extend to include worm 14 and define a fork between which body 35 housing nut screw 20 is mounted in idle manner, the whole coaxial with worm 14.

The relative angular position of nut screw body 35 may be fixed, e.g. as determined by the position of a hole 40 (FIGS. 1 and 2) formed through one of tabs 37 to which body 35 is fitted angularly integral by means of an eye 41 and a screw, pin or other connecting member (not shown) engaging both eye 41 and hole 40; or it may be controlled "dynamically" as a function of the axial position of slide 11 by cam means 45, which may be fitted integral with fixed support 13, parallel to axis A, at worm 14.

According to a first embodiment shown in FIGS. 1, 2, 3 and 4, half elements 30 of the nut screw consist of two half shells 30*a* and 30*b* formed by longitudinally sectioning nut screw 20 along a diametrical plane of worm 14. Half shell 30*b* is mounted in axially fixed manner to nut screw body 35 by means of pins 50 (or other means), while the other half shell 30*a* is mounted in axially movable manner in relation to nut screw body 35, and presents, radially outwards, an opening or slot 51 in which is inserted, in axially slack manner, a spherical-wedge-shaped cam 52 varying angularly in thickness measured along axis A. Spherical-wedge-shaped cam 52 (FIG. 4) cooperates with one side of opening 51, and is mounted for rotation, parallel to axis A, inside a radial seat 55 formed in an appropriately shaped portion of nut screw body 35.

In a second embodiment shown in FIG. 5, half elements 30 of the nut screw consist of two rings 30*c* and 30*d* formed by transversely sectioning nut screw 20 perpendicular to axis A of worm 14. Both rings are mounted in axially movable manner in relation to nut screw body 35, and between the adjacent ends of the rings is inserted a spherical-wedge-shaped cam 52 identical to the previous one and varying angularly in axial thickness. Spherical-wedge-shaped cam 52 thus cooperates on either side with said adjacent ends of rings 30*c* and 30*d*—in the example shown, with respective portions 60 of the rings provided for the purpose—and, as already described, is mounted for rotation, parallel to axis A, inside seat 55 in nut screw body 35.

In both the above embodiments, cams 52 are supported on a pin 62 fitted through seat 55 parallel to worm 14, and may be locked angularly as required via axial pressure means. In the example shown, pins 62 are mounted idly through body 35, are threaded at at least one end, and present respective lock nuts (or heads) 63 on the outside of body 35, for locking pins 62 angularly inside seats 55. Cams 52 are fitted in fixed manner to respective pins 62, and present a prismatic control head 65 grippable by means of a tool and projecting from seat 55 outwards of body 35.

Figure 6:
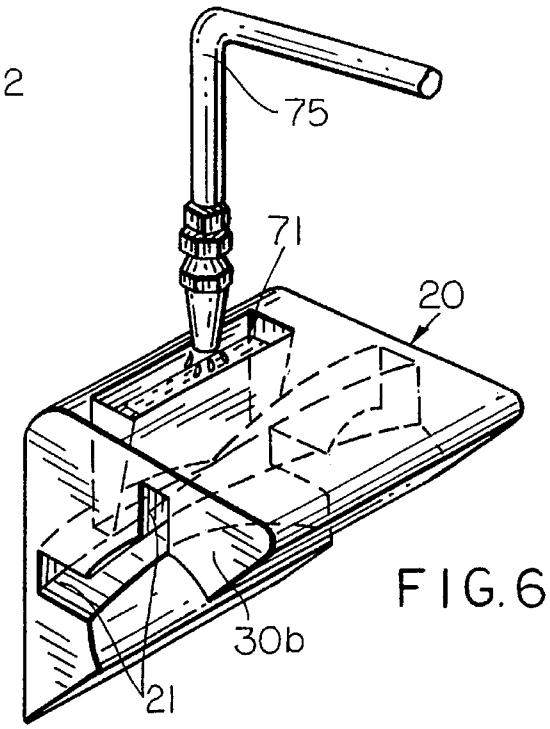
FIG. 6 shows a schematic view in perspective of a further detail on the device according to the present invention.

Half elements 30 of the nut screw are lockable angularly inside body 35 by virtue of being externally prismatic, and being housed inside a mating prismatic cavity 70 formed inside body 35, parallel to the axis of worm 14. As shown in FIG. 6, half elements 30 preferably present radial channels 71 for feeding lubricant directly to the worm reading means—in the example shown, defined by straightforward through openings terminating laterally in helical grooves 21 and supplied by gravity, on the outside of half element 30, with oil from a pipe 75. If necessary, channel 71 may be closed on the outside of element 30 and connected directly in fluidtight manner (by means of a union) to pipe 75 for enabling pressurized lubricant supply.

In actual use, any slack between worm 14 and reading means 21 on nut screw 20 is easily adjusted according to the present invention by loosening the means locking pin 62, and gripping head 65 for rotating cam 52 in such a direction as to bring the progressively thicker portions of the cam into contact with nut screw 20. In this way (FIG. 4), the axially free half shell 30*a* is so stressed by cam 52 as to slide axially in the direction of the arrow, parallel to worm 14, and cam 52, as it penetrates gradually inside opening 51, acts on the lateral wall of the opening until the required slack is achieved. In the FIG. 5 embodiment, on the other hand, operation of cam 52, which is identical to that described above, provides for progressively parting rings 30*c* and 30*d*, parallel to axis A, and so adjusting any slack between grooves 21 and threads 15. Both the above systems are of course mechanically equivalent, in that the first (FIG. 4) acts on the entire length of nut screw 20 but involves only half of threads 15, while the second (FIG. 5) acts on a length equal to half the length of nut screw 20 (rings 30*c* and 30*d* are the same length) but involves all of threads 15.

For normal use, e.g. with negative grippers and high translation speeds of gripper 3, body 35 is maintained integral with slide 11, and pinion 18 is rotated reciprocatingly, as described previously. For applications requiring greater flexibility, e.g. for achieving highly characteristic laws of motion but lower gripper speeds typical of positive grippers, body 35 need simply be released, e.g. by removing the lock member from elements 40 and 41, to enable body 35 to rotate about axis A, and support 13 be fitted with cam means 45 defined, in the example shown, by a curved plate 81 (FIGS. 2 and 3) having its center of curvature coincident with axis A of the worm, and by an opening 82 of predetermined shape (FIGS. 1 and 3) formed through and along the generating lines of plate 81.

According to the present invention, provision is made on the outside of body 35 for a pawl 80—either fixed or secured in removable manner (e.g. by screwing it inside a radial hole in body 35)—projecting radially from body 35 and designed to engage cam means 45 (if provided)—in the example shown, to roll inside opening 82. In this way, nut screw. 20 is forced to rotate relatively in relation to worm 14 and according to a law depending on the contour of opening 82, which rotation, depending on whether it is in the same or opposite direction to the rotation of worm 14, increases or decreases the angle of rotation of worm 14 so as to increase or decrease acceleration of gripper 3 as required.

Theoretically, it may also be possible to invert rotation of pinion 18 prior to inverting translation of slide 11, providing the correction imparted by the shape of opening 82 exceeds the helix angle of worm 14. Clearly, therefore, the device described poses practically no limits to the law of motion of gripper 3; and—a useful feature for achieving a longitudinally compact device—may also be operated as a straightforward overgear by adding rotation of nut screw 20 to that of worm 14.

I claim:

1. A device (1) for controlling at least one gripper strap (2) on continuous weft feed looms, comprising:

a connecting rod-crank drive mechanism (10) for controlling translation of a slide (11) along a straight path defined by fixed guide means (12,13);

a worm screw (14) parallel to said path and mounted in an idleable manner on a fixed support (13) integral with said guide means, said worm screw (14) being fitted to a pinion (18) controlling at least one gripper strap (2); and a nut screw (20) in a nut screw body (35) associated said slide (11) and having worm screw reading means (21) for engaging and rotating said worm screw (14) as a consequence of said translation of said slide (11) along said path, said nut screw (20,35) comprising at least two half elements (30) each having said worm screw reading means (21) said half elements being adapted to be adjustable relative to said worm screw (14) in order to maintain a desired level of slack; wherein:

(i) said at least two half elements (30) are mounted within the slide (11) so as to be movable relative to each other along an axis (A) of said worm screw; and (ii) first cam means (32) fitted one of to said slide (11) and said nut screw body (35) surrounding said elements (30) for relatively displacing in opposite directions said half elements (30) of said nut screw (20) such that any undesired level of slack between worm screw threads (15) and said reading means (21) is taken up.

2. The device (1) as claimed in claim 1, wherein said half elements (30) are fitted in an angularly fixed manner inside said nut screw body (35) and integral with said slide (11).

3. The device (1) as claimed in claim 2, wherein said nut screw body (35) is integral in one body with said slide (11).

4. The device (1) as claimed in claim 2, wherein said worm screw (14) has a fixed pitch; and said nut screw body (35) is mounted in axially fixed but angularly idleable manner on said slide (11) relative to said axis (A) of said worm screw (14); and further comprising second cam means (45) for an angular position of said nut screw body (35) to be controlled as a function of an axial position of said slide (11), said second cam means (45) being integral with said fixed support.

5. The device (1) as claimed in claim 2, wherein said half elements (30) comprise first add second half shells (30*a*,30*b*) longitudinally sectioning said nut screw (20) along a diametrical plane of said worm screw (14), said first half shell (30*b*) being axially locked relative to said nut screw body (35) and said second half shell (30*a*) being adapted to be axially movable relative to said nut screw body (35) and having a radially outward opening (51), said device further comprising a spherical-wedge-shaped cam (52) positioned in said opening in an axially slack manner and varying angularly in axial thickness for cooperating with one side of said opening (51), said spherical-wedge-shaped cam being mounted for rotation parallel to said axis (A) of said worm (14) inside a radial seat (55) in said nut screw body (35), and axial pressure means for angularly locking said spherical-wedge-shaped cam in said radial seat.

6. The device (1) as claimed in claim 2, wherein said half elements (30) comprise two rings (30*c*,30*d*) transversely sectioning said nut screw (20) perpendicularly to said axis of (A) of said worm screw (14), both of said rings (30*c*,30*d*) being adapted to be axially movable relative to said nut screw body (35);

said device further comprising a spherical-wedge-shaped cam (52) between said rings and varying angularly in axial thickness, said spherical-wedge-shaped cam (52) cooperating with said rings, a radial seat (55) in said nut screw body (35) mounting said spherical-wedge-shaped cam for rotation parallel to said axis (A) of said worm screw (14) and axial pressure means for angularly locking said spherical-wedge-cam in said radial seat.

7. The device (1) as claimed in claim 5, wherein said half elements (30) are externally prismatic and housed inside a mating prismatic cavity (70) that is axially parallel to said axis (A) of said worm screw (14) and inside said nut screw body (35).

8. The device (1) as claimed in claim 1, wherein said half elements (30) have radial channels (71) for supplying a lubricant directly to said worm reading means (21).

* * * * *

UNITED STATES PATENT AND TRADEMARK OFFICE

CERTIFICATE OF CORRECTION

PATENT NO. : 5,601,121

DATED : February 11, 1997

INVENTOR(S) : Carlo BONACINA

It is certified that error appears in the above-indentified patent and that said Letters Patent is hereby corrected as shown below:

On title page, item 73 Assignee, "Intrapatent" should be -- Interpatent --.

Signed and Sealed this

Twenty-seventh Day of May, 1997

*Attest:*

*Attesting Officer*

Bruce Lehman

BRUCE LEHMAN

*Commissioner of Patents and Trademarks*